US012077918B2

(12) United States Patent
Bradford et al.

(10) Patent No.: US 12,077,918 B2
(45) **Date of Patent: *Sep. 3, 2024**

(54) COVER ASSEMBLY FOR STRUCTURAL MEMBERS

(71) Applicant: SIKA tECHNOLOGY AG, Baar (CH)

(72) Inventors: Paul Bradford, Orchard Park, NY (US); Jeffrey Kuchta, Buffalo, NY (US)

(73) Assignee: SIKA TECHNOLOGY AG, Baar (CH)

( * ) Notice: Subject to any disclaimer, the term of this patent is extended or adjusted under 35 U.S.C. 154(b) by 735 days.

This patent is subject to a terminal disclaimer.

(21) Appl. No.: 16/994,614

(22) Filed: Aug. 16, 2020

(65) Prior Publication Data

US 2020/0378072 A1 Dec. 3, 2020

Related U.S. Application Data

(63) Continuation of application No. 15/298,308, filed on Oct. 20, 2016, now Pat. No. 10,767,320.

(51) Int. Cl.
*E01C 11/02* (2006.01)
*E01C 11/10* (2006.01)
(Continued)

(52) U.S. Cl.
CPC ..... *E01C 11/126* (2013.01); *E01C 11/106* (2013.01); *E01D 19/062* (2013.01); *E04B 1/681* (2013.01)

(58) Field of Classification Search
CPC ..... E04F 15/14; E01D 19/06; E01D 19/062; E01D 19/065; E01C 11/02; E01C 11/04; E01C 11/106; E01C 11/126
See application file for complete search history.

(56) References Cited

U.S. PATENT DOCUMENTS 1,799,574 A 4/1931 Ward
2,145,951 A 2/1939 Robertson
(Continued)

FOREIGN PATENT DOCUMENTS

CH 630978 A5 7/1982
DE 102005058087 A 6/2007
(Continued)

OTHER PUBLICATIONS

International Search Report for Application No. PCT/US2007/025625, mailed Aug. 21, 2008.
(Continued)

*Primary Examiner* — Thomas B Will
*Assistant Examiner* — Katherine J Chu
(74) *Attorney, Agent, or Firm* — Oliff PLC

(57) ABSTRACT

An expansion joint system for bridging an expansion joint gap between two spaced-apart, underlying building or roadway structures. The expansion joint system includes a cover plate, at least one swing arm, sliding bearings engaged with the swing arms, and fasteners for engaging the swing arms to the cover plate. The swing arms include a receiving well configured for receiving a mechanical fastener to fasten the swing arms to the cover plate. The expansion joint system permits movement in response to a seismic or thermal event that causes expansion or contraction of the gap between structural members while maintaining coverage of the gap, and following a seismic or thermal event, the maintains a substantially-centered position of the cover plate.

3 Claims, 10 Drawing Sheets

(51) Int. Cl.

| | |
|---|---|
| ***E01C 11/12*** | (2006.01) |
| ***E01D 19/06*** | (2006.01) |
| ***E04B 1/68*** | (2006.01) |

(56) References Cited

U.S. PATENT DOCUMENTS

| | | | | |
|---|---|---|---|---|
| 3,183,626 | A | 5/1965 | Schmitt | |
| 3,363,522 | A | 1/1968 | Galbreath | |
| 3,435,574 | A | 4/1969 | Hallock | |
| 3,448,552 | A | 6/1969 | Schmitt et al. | |
| 3,648,423 | A | 3/1972 | Cole | |
| 3,659,390 | A | 5/1972 | Balzer et al. | |
| 3,696,575 | A | 10/1972 | Armstrong et al. | |
| 3,745,726 | A | 7/1973 | Thom | |
| 3,758,220 | A | 9/1973 | Hein | |
| 3,810,707 | A | 5/1974 | Tungseth et al. | |
| 3,849,958 | A | 11/1974 | Balzer et al. | |
| 3,862,810 | A | 1/1975 | Welch | |
| 3,899,261 | A | 8/1975 | Mieville | |
| 3,974,609 | A | 8/1976 | Attaway | |
| 3,974,614 | A | 8/1976 | Strong | |
| 4,022,538 | A | 5/1977 | Watson et al. | |
| 4,030,156 | A * | 6/1977 | Raymond | E01D 19/062 404/69 |
| 4,067,155 | A | 1/1978 | Ruff et al. | |
| 4,087,191 | A | 5/1978 | Brady et al. | |
| 4,120,066 | A | 10/1978 | Leroux | |
| 4,132,491 | A * | 1/1979 | Scheffel | E01D 19/062 404/56 |
| 4,184,298 | A | 1/1980 | Balzer et al. | |
| 4,271,650 | A | 6/1981 | Lynn-Jones | |
| 4,307,974 | A | 12/1981 | George | |
| 4,411,582 | A | 10/1983 | Nakada | |
| 4,654,245 | A | 3/1987 | Balzer et al. | |
| 4,674,912 | A | 6/1987 | Buckenauer | |
| 4,706,318 | A | 11/1987 | Huber et al. | |
| 4,815,247 | A | 3/1989 | Nicholas et al. | |
| 4,823,452 | A | 4/1989 | Cloutier | |
| 4,876,759 | A | 10/1989 | Yang | |
| 4,934,863 | A | 6/1990 | Brantner, Jr. | |
| 5,020,294 | A | 6/1991 | Duda | |
| 5,024,554 | A | 6/1991 | Benneyworth et al. | |
| 5,048,249 | A | 9/1991 | Shreiner et al. | |
| 5,051,024 | A * | 9/1991 | Warthmann | E01D 19/065 404/66 |
| 5,060,439 | A | 10/1991 | Clements et al. | |
| 5,067,297 | A | 11/1991 | Sobol | |
| 5,082,394 | A | 1/1992 | George | |
| 5,092,094 | A | 3/1992 | Duda et al. | |
| 5,211,505 | A | 5/1993 | Ueda | |
| 5,224,319 | A | 7/1993 | Nicholas | |
| 5,263,293 | A * | 11/1993 | Gohlke | E04B 1/948 52/396.01 |
| 5,269,624 | A | 12/1993 | Kramer | |
| 5,302,050 | A | 4/1994 | Buckenauer et al. | |
| 5,543,987 | A | 8/1996 | Matsumoto | |
| 5,644,879 | A | 7/1997 | Shreiner et al. | |
| 5,779,456 | A | 7/1998 | Bowes et al. | |
| 5,791,111 | A | 8/1998 | Beenders | |
| 5,887,400 | A | 3/1999 | Bratek et al. | |
| 5,888,017 | A | 3/1999 | Corrie | |
| 5,911,662 | A | 6/1999 | Hallsten | |
| 6,022,169 | A | 2/2000 | Kim | |
| 6,112,488 | A | 9/2000 | Olson et al. | |
| 6,115,980 | A | 9/2000 | Knak et al. | |
| 6,125,596 | A | 10/2000 | Goto | |
| 6,418,677 | B1 | 7/2002 | Goto | |
| 6,449,265 | B1 | 9/2002 | Prieto | |
| 6,449,790 | B1 | 9/2002 | Szekely | |
| 6,527,467 | B2 | 3/2003 | Betts | |
| 6,751,918 | B2 | 6/2004 | Jesko | |
| 6,751,919 | B2 | 6/2004 | Calixto | |
| 6,912,751 | B2 | 7/2005 | Bradford et al. | |
| 7,080,491 | B1 | 7/2006 | Shreiner et al. | |
| 7,252,454 | B2 | 8/2007 | Bradford et al. | |
| 7,823,822 | B2 * | 11/2010 | Raymond | F16B 5/025 241/261.2 |
| 8,267,617 | B2 | 9/2012 | Bradford et al. | |
| 8,454,294 | B2 | 6/2013 | Bradford et al. | |
| 8,887,463 | B2 | 11/2014 | Derrigan et al. | |
| 10,053,857 | B1 | 8/2018 | Gebhardt | |
| 10,119,274 | B2 | 11/2018 | Braun | |
| 10,767,320 | B2 * | 9/2020 | Bradford | E04B 1/681 |

FOREIGN PATENT DOCUMENTS

| | | |
|---|---|---|
| EP | 0771906 B1 | 5/2000 |
| JP | H06322848 | 11/1994 |
| JP | H06322849 | 11/1994 |

OTHER PUBLICATIONS

International Written Opinion for Application No. PCT/US2007/025625, mailed Aug. 21, 2008.

International Preliminary Report on Patentability for Application No. PCT/US2007/025625, mailed May 3, 2016.

* cited by examiner

COVER ASSEMBLY FOR STRUCTURAL MEMBERS

CROSS REFERENCE TO RELATED APPLICATIONS

The present application is a continuation of U.S. Ser. No. 15/298,308 filed on Oct. 20, 2016, which is hereby incorporated by reference in its entirety.

TECHNICAL FIELD

Disclosed is a protective cover assembly for placement over a gap or opening that is located between adjacent horizontal structures. The protective cover assembly spans the gap or opening between two spaced-apart adjacent horizontal concrete structures. The protective cover assembly permits a smooth transition of pedestrian or vehicular traffic across the gap or opening located between the adjacent horizontal concrete structures.

BACKGROUND

An expansion joint is formed by purposely providing an opening or gap between adjoining structural members for accommodating dimensional changes to the gap occurring as expansion and contraction due to temperature changes and/or seismic cycling and vibration.

An expansion joint cover assembly is placed over the expansion joint gap to prevent the ingress of debris and water into the gap and to provide a smooth transition for pedestrian and vehicular traffic across the expansion joint gap. The expansion joint may be damaged by the ingress of debris and water but, also by abrasion and compression forces generated by the passage of motorized vehicular traffic across the expansion joint gap.

Elongated metal plates placed in an end-to-end relationship have been secured to concrete structural members in an attempt to protect the expansion joint from damage due to pedestrian and vehicular traffic. The metal plates often become deformed and do not form a uniform seated engagement with concrete structures, particularly where the traffic bearing upper surfaces of the adjacent concrete structures are irregular or undulating and therefore fail to provide the necessary uniform planar support for the metal plates. Under these conditions, the metal plates may be bent and distorted due to impact loading of traffic and acquire a state of looseness about their mounting bolts which degrades further when the mounting bolts bend or break.

Known expansion joint cover assemblies include spacing mechanisms that attempt to stabilize the cover plates in a centered or default position across the expansion joint gap. These spacing and realignment mechanisms stabilize the cover plates by adding mass, as well as by utilizing members engaged with the cover plate itself to facilitate return of the cover plate to its default position deformation to the expansion joint caused by seismic cycling and vibration, thermal cycling, or traffic.

A need still exists in the art for an improved expansion joint cover plate assembly including an improved swing arm equidistance system that (1) does not corrode, (2) provides a pretensioned spring force on the cover plate of the assembly, (3) is easy to install, (4) is easily replaceable, (5) allows the cover plate to accommodate slab differential movements, (6) is rigid enough to prevent excessive cover plate bouncing and misalignment, and (7) is cost effective. There is also a need to provide improved means of installation that reduces the difficulties of blindly installing the expansion joint cover plate assembly within an expansion joint gap.

SUMMARY

Provided is a cover assembly for a gap between spaced-apart structural members comprising base members configured to be affixed to each of said structural members and having channels configured to accept bearings, a cover plate having a width sufficient to bridge said gap between said structural members, swing arms pivotably engaged with said cover plate, and bearings engaged at opposite ends of said swing arms and slidably engaged with said channels of said base members, wherein said bearings comprise a substantially planar tab portion and an elongated cylindrical portion.

According to certain illustrative embodiments, also provided is a cover assembly for a gap between spaced-apart structural members comprising base members configured to be affixed to each of said structural members and having channels configured to accept bearings, a cover plate having a width sufficient to bridge said gap between said structural members, swing arms pivotably engaged with said cover plate, wherein said swing arms having a substantially centrally positioned fastener receiver extending upwardly from a surface of said swing arms, wherein said fastener receiver defined by an opening comprising an inverted conical inner surface in the direction of said surface of said swing arms and transitioning into a fastener alignment shoulder, and a locking member extending downwardly from said fastener alignment shoulder, and bearings engaged at opposite ends of said swing arms and slidably engaged with said channels of said base members.

According to other illustrative embodiments, further provided is a cover assembly for a gap between spaced-apart structural members comprising base members configured to be affixed to each of said structural members and having channels configured to accept bearings, a cover plate having a width sufficient to bridge said gap between said structural members, swing arms pivotably engaged with said cover plate, bearings engaged at opposite ends of said swing arms and slidably engaged with said channels of said base members, and mechanical fasteners engaging said swings arms to said cover plate, wherein said fasteners comprise an elongated externally threaded bolt terminating in a non-metallic bullet-shaped tip.

DETAILED DESCRIPTION

Figure 1A:
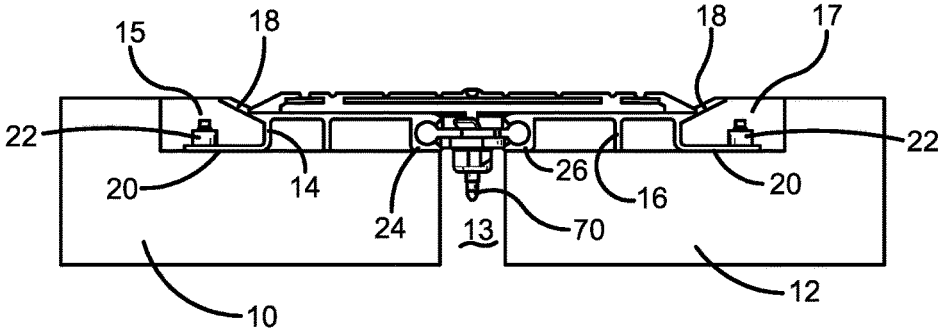
FIGS. 1A-1C show cross-section views of an illustrative embodiment of the expansion joint cover assembly in the fully closed, neutral and fully open positions.

Disclosed is a cover assembly for a gap between two structural members. The cover assembly for the expansion joint gap has a longitudinal axis that is substantially transverse to the direction of pedestrian or vehicular traffic across the cover assembly. The cover assembly comprises base members that are configured to extend along the longitudinal axis of the cover assembly and to be affixed to each of the spaced apart structural members on opposite sides of the expansion joint gap. Each of the elongated base members includes an elongated channel that is configured to accept slide bearings. The cover assembly also includes elongated swing arms that are spaced apart along a longitudinal axis of the cover assembly. The elongated swing arms are positioned substantially traverse to the longitudinal axis of the cover assembly when the cover assembly is in the fully open position in the expansion joint gap. According to certain illustrative embodiments, the elongated swing arms are positioned at substantially evenly spaced intervals along the longitudinal axis of the cover assembly. The distance between the spaced apart swing arms along the longitudinal axis of the cover assembly is maintained by fastening the swing arms to the cover plate via openings in the cover plate at selected locations along the long axis of the cover plate.

Each of the spaced apart elongated swing arms includes opposite longitudinal ends that carry or engage slide bearings. According to certain illustrative embodiments, the slide bearings are removably engaged with the spaced apart swing arms. An elongated spacer arm may be engaged to the spaced part swing arms. When the cover assembly is in fully open position, the spaced apart elongated swing arms extend in the intended direction of traffic across the cover assembly and the elongated spacer arm, if included in the assembly, extends substantially traverse to the intended direction of traffic across the cover assembly. A cover plate member is engaged with the spaced apart elongated swing arms and bridges the gap between the spaced apart structural members.

Each of the spaced apart elongated swing arms of the cover assembly have opposite facing first and second surfaces. The spaced apart swing arms further comprise a fastener receiver configured for receiving a suitable fastener for connecting the spaced apart swing arms to the cover plate of the cover assembly. The fastener receiver extends in an upwardly direction from the first surface of each of spaced apart swing arms. The fastener receiver further includes an opening that communicates through the first and second opposite facing surfaces of the spaced apart swing arms that permits passage of a suitable fastener. A portion of the opening of the fastener receiver comprises an inverted conical inner surface extending in the direction of the first surface of the spaced apart swing arms. The circumference of the inverted inner conical surface decreases as it transitions toward the first surface of the swing arms. The inverted conical surface of the fastener receiver transitions into a fastener alignment shoulder. The fastener receiver further comprises a locking member that extends in a downwardly direction from the fastener alignment shoulder.

The swing arms may be manufactured from polymers, metals, metal alloys and composite materials. According to certain illustrative embodiments, the elongated swing arms of the expansion joint cover assembly is manufactured from a polymer material. According to further illustrative embodiments, the polymer material that may be used to manufacture the elongated swing arms is a nylon-based material. The elongated swing arms are designed to flex when the arms are pulled upwardly.

The swing arms of the expansion joint cover assembly may be manufactured from a material that exhibits a yield stress of 50 Mpa and greater. According to certain illustrative embodiments, the material used to manufacture the swing arms may exhibit a yield stress of 60 Mpa and greater.

The swing arms of the expansion joint cover assembly may be manufactured from a material that exhibits a yield strain of 20 mm/mm and greater. According to certain illustrative embodiments, the material used to manufacture the swing arms may exhibit a yield strain of 25 mm/mm and greater.

The swing arms of the expansion joint cover assembly may be manufactured from a material that exhibits a strain and break of 50 mm/mm and greater. According to certain illustrative embodiments, the material used to manufacture the swing arms may exhibit a strain and break of 60 mm/mm and greater.

The swing arms of the expansion joint cover assembly may be manufactured from a material that exhibits a tensile modulus of about 1,500 to about 2,500 Mpa. According to certain illustrative embodiments, the material used to manufacture the swing arms may exhibit a tensile modulus of about 1,500 to about 2,000 Mpa.

The swing arms of the expansion joint cover assembly may be manufactured from a material that exhibits a Charpy Impact of 10 $kJ/m^2$ or greater. According to certain illustrative embodiments, the material used to manufacture the swing arms may exhibit a exhibits a Charpy Impact of 15 $kJ/m^2$ or greater.

The swing arms of the expansion joint cover assembly may be manufactured from a material that exhibits a water absorption of 3% or less. According to certain illustrative embodiments, the material used to manufacture the swing arms may exhibit a water absorption of 2% or less.

Without limitation, a suitable polymer material that may be used to manufacture the swing arms of the expansion joint cover assembly is a polyamide material. Suitable polyamide materials include PA66 materials. Suitable commercially available PA 66 polyamide materials include Zytel 105F from E.I. du Pont de Nemours and Company (Wilmington, DE, USA) and Ultramid from BASF Corporation (Florham Park, NJ, USA).

The polymeric swing arms made from a suitable polyamide material function as both as a spring and for maintaining cover plate equidistance. The polymeric swing arms possess a selected spring rate that enables the swing arms to be pulled toward the bottom surface of the cover plate as the cover plate is being fastened (ie, as the cover plate is being tightened down with the fastener) during installation of the cover assembly across an expansion joint gap. This spring rate enables at least a portion of the swing arms, such as a center portion of the swing arms, to be pulled up into adjacent contact against the bottom surface of the cover plate of the assembly.

The fastener fastens the cover plate of the cover assembly to the underlying spaced apart swing arms to maintain the cover plate in proper center position during use of the cover assembly. According to certain illustrative embodiments, the fastener comprises an elongated externally threaded bolt and the locking member comprises an internally threaded locking nut. The fastener comprises an elongated externally threaded bolt terminating in a bullet-shaped tip. The elongated externally threaded bolt may be made from a metal or metal alloy material, and the bullet-shaped tip of the elongated externally threaded bolt may be made from a non-metallic material. By way of illustration the bullet-shaped tip of the externally threaded bolt may be comprised of a polymer material. Without limitation, and only by way of illustration, the fasteners engage the cover plate to the elongated spaced apart swing arms substantially along the median portion of the cover plate.

Each of the opposite ends of the spaced apart elongated swing arms comprises openings communicating through the opposite facing first and second surfaces of the spaced apart arms. Slide bearings are movably engaged with the opposite ends of the arms with fasteners that are engaged with the openings. The slide bearings may be engaged with the elongated swing arms by mechanical fasteners that pass through openings formed in the bearings and swing arms. The bearings are pivotable or otherwise rotatable about the fastener that fastens the bearings to the swing arms. The slide bearings are slidably engaged with elongated rails or tracks formed in the base members located on each side of the expansion joint gap. The sliding engagement of the slide bearings with the rails permits the spaced apart arms of the assembly to slide along the longitudinal axis of the cover plate assembly and to pivot in response to opening and closing movement of the expansion joint gap.

The optional elongated spacer arm of the cover plate assembly comprises opposite facing first and second surfaces. The spacer arm includes a longitudinal axis and arm portions that flare outwardly along the longitudinal axis from the center of the arm toward the opposite first and second ends. That is, the width of the arm portions of the spacer arm at the opposite ends are greater than the width near the center of the spacer arm. The elongated spacer arm further includes openings at each of the opposite first and second ends that communicate through the opposite facing first and second surfaces of the spacer arms. These opposite first and second openings of the elongated spacer arm are engaged with the receivers extending in an upward direction from the first surface of the spaced apart swing arms.

The cover plate of the cover assembly comprises any suitable rigid plate that has a width sufficient to bridge or span the expansion joint gap and which can support pedestrian and vehicular traffic. According to certain embodiments, the rigid plate may be engaged with the resilient elastomeric cover by encapsulating the rigid plate within the elastomeric cover material. Alternatively, the rigid plate may be secured to the underside support surface of the resilient elastomeric cover by any suitable attachment or securement means. For example, but not in limitation, the rigid plate may be engaged to the underside of elastomeric cover by mechanical fasteners and/or adhesives. Useful cover plates for the cover assembly are not limited to those illustrative embodiments disclosed herein.

In addition to the rigid plate that bridges the expansion joint gap between the spaced-apart structural members, the cover plate may also include additional rigid plate members engaged with the resilient elastomeric cover that extend in a side-by-side relationship on opposite lateral sides of the rigid plate that bridges the expansion joint opening. These additional rigid plate members may be engaged with the resilient elastomeric cover in the same manner as the rigid plate member that spans the expansion joint opening. The further inclusion of additional rigid plate members located on opposite lateral sides of the rigid plate member allows for elastic deformation of the resilient cover and applies a biasing force in a direction to urge opposite lateral sides of the cover toward the horizontal structural members when resiliently deformed by traffic traversing said load bearing surface.

According to certain illustrative embodiments, the elongated resilient cover further comprises peripheral edges including tapered face surfaces for providing incline planes to bear traffic traversing the elongated resilient cover.

According to certain illustrative embodiments, the traffic bearing surface of the elongated resilient cover includes spaced apart upstanding ribs arranged to extend transversely to the direction of traffic traversing the cover.

The resilient cover has a thickness and sufficient elasticity to elastically deform for establishing supporting contact between the marginal support areas of the cover and the underlying base members. Without limitation, suitable elastomeric materials used to prepare the resilient cover include styrene-butadiene rubber (SBR), butadiene rubber (BR), butyl rubber, ethylene-propylene rubber (EPM), ethylene-propylene-diene rubber (EPDM), polyisoprene rubber, polychloroprene rubber, various ethylene-alkene copolymer rubbers, silicon rubber, nitrile rubber, and combinations thereof.

According to certain illustrative embodiments, ethylene-propylene-diene rubber (EPDM) is utilized to prepare the resilient cover of the cover plate. A particularly suitable EPDM rubber composition that is useful to prepare the resilient cover is commercially available from Advanced Elastomer Systems, L.P. (Akron, Ohio) under the trade name SANTOPRENE®.

According to certain illustrative embodiments, an expansion joint is provided. The expansion joint comprises two spaced structural members defining a gap between the two structural members. By way of example, the spaced apart structural members comprise concrete structural members. According to certain embodiments, the structural members comprises spaced apart horizontal structural members.

A base member of the cover plate assembly is affixed to each of the spaced apart structural members on opposite sides of the expansion joint gap. The base members along with the peripheral margins (or edges) of the structural members define the boundaries of the gap between the horizontal structures.

The base members have sufficient strength to support elements placed on them as well as the loads imparted by pedestrian and vehicular traffic traversing the cover assembly. The base members may be comprised of a material of strength sufficient to withstand forces which may be applied to the base members. These forces will depend upon the particular application and can be readily determined by the skilled artisan. Without limitation, suitable materials that may be used to manufacture the base members of the cover assembly include metals, metal alloys, polymers, and composite materials.

Without limitation, the base members are attached to the horizontal structures with mechanical fasteners that may comprise anchors, bolts, nails, rivets, screws, tacks, and the like. Without limitation, the base members include a suitable cavity, channel, housing, notch, passage, recess, slot, track, rail, or groove configured to accept the slide bearings that are attached to the elongate swing arms of the cover assembly, which allows the sliding bearings to move within the channel in a direction in the longitudinal axis of the expansion joint cover assembly, in order to maintain equilibrium with the swing arms during expansion and contraction of the gap defined by the horizontal structures and base members.

The opposite terminal ends of elongated swing arms spaced apart along a longitudinal axis of the cover assembly are pivotably engaged with the base members of the cover assembly via the slide bearings. The swing arms are engaged with slide bearings on either end of the arm that are, in turn, engaged with and movable within the rails or channels formed in the base members. During contraction of the gap between base members, the distance between the sliding bearings on the swing arm is increasing in the longitudinal direction but equilibrium is maintained by decreasing the distance between the sliding bearings in the transverse direction, the vertical direction, or both, such that the swing arm itself need not change in length. During expansion of the gap between members, the distance between the sliding bearings on the swing arm is decreasing in the longitudinal direction but equilibrium is maintained by increasing the distance between the sliding bearing in the transverse direction, the vertical direction, or both, such that the swing arm itself need not change in length.

Certain embodiments of the expansion joint cover assembly may include an elongated spacer arm extending in the direction of the longitudinal axis of the cover assembly between two adjacent swing arms. The elongated spacer arm is movably engaged with the spaced apart elongated swing arms. The elongated spacer arm aligns the swing arms when the cover plate is removed from the cover assembly so that once the cover plate is moved into position to be secured to the cover assembly, the fastener openings in the cover plate will be aligned with the openings provided in the fastener receiver (fastener receiving well) in the swing arms. The elongated spacer arm maintains distance between adjacent swing arms when a plurality of swing arms are used in the assembly. While the elongated spacer arm assists in installation of the expansion joint cover assembly across the expansion joint gap by aligning the openings of the cover plate and fastener receiver of the elongated swing arms, it provides no further function to the cover assembly after installation or during use.

During such expansion and contraction of the gap between base members, the center of the swing arm remains substantially stable relative to the cover plate via the fastener, which connects the swing arm to the cover plate. The fastener passes through the cover plate and engages with the swing arm via the fastener receiver, fastener alignment shoulder, and locking member, which aid installation by aligning the swing arm and fastener, which is helpful as the fastener is installed into the swing arm through the cover plate, and therefore, is done somewhat blindly.

Figure 1B:
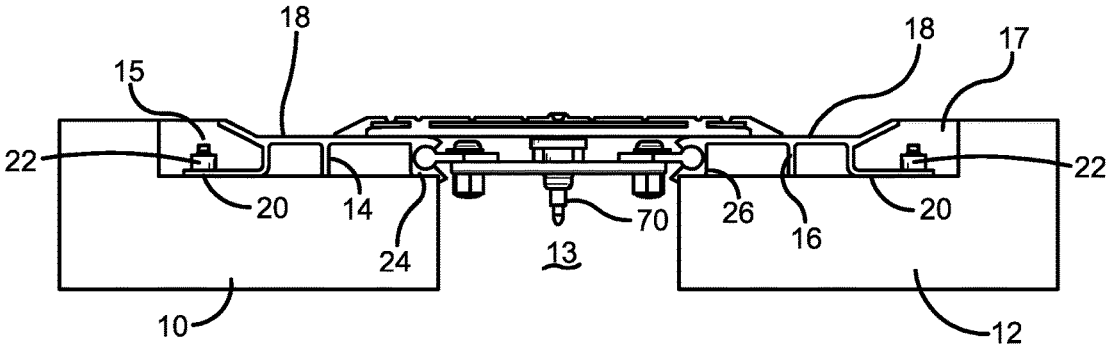
Figure 1C:
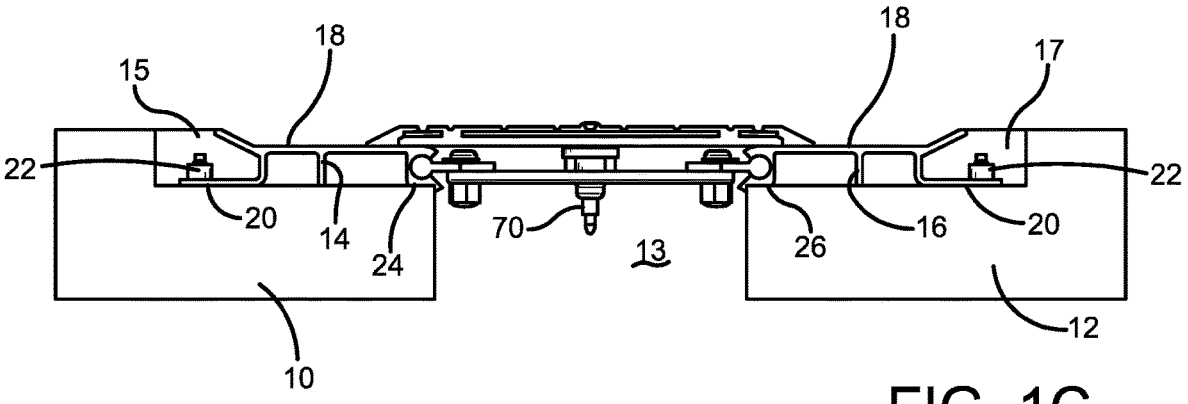

According to the illustrative embodiments shown in FIGS. 1A-1C, structural members 10, 12 are separated by a gap 13. The structural members 10, 12 may be precast slabs used to form passageways for both vehicle and pedestrian traffic. The structural members 10, 12 are supported by underlying superstructure (not shown). In the embodiments shown, the structural members 10, 12 have material removed to provide spacing for accepting the base members 14, 16 of the cover assembly. The area defined by the removed material is often referred to by those having skill in the industry as a "block out". The block out regions are identified as 15, 17 in structural members 10, 12. In certain embodiments, the removal of material allows the base members 14, 16 to be at least partially recessed within the structural members 10, 12. In certain embodiments, locating the base members 14, 16 in the block-out regions 15, 17 decreases the overall height difference between the fully installed cover assembly and that of the upper traffic bearing surfaces of the horizontal structural members 10, 12. Base members 14, 16 provide an interface or connection between the structural members 10, 12 and other components of the cover assembly. The base members 14, 16 engage the swing arms and support the elongated cover plate component of the expansion cover assembly.

Each of the base members 14, 16 may be provided as a single unitary part. Alternatively, each of the base members 14, 16 may be composed of a plurality of components, elements, parts, or sub-assemblies that are joined together. The parts or sub-assemblies composing the base members may be joined by mechanical fasteners, adhesives or other means. The base members 14, 16 have strength to support elements placed upon them as well as the loads imparted to those elements by pedestrian or vehicular traffic. The base members 14, 16 may be comprised of a material of strength sufficient to the withstand forces which may be applied to the base members. These forces will depend upon the particular application and can be readily determined by the skilled artisan.

Still referring from FIGS. 1A-1C, the base members 14, 16 comprise a top portion 18 upon which additional elements of the cover assembly may be positioned for support by the base members 14, 16. The base members 14, 16 also comprise bottom portions 20, which are positioned in contact with supporting regions of the underlying structural members 10, 12. The surfaces 20 positioned in contact with supporting regions of the structural members 10, 12 may include the plates, legs, ribs, or other structures configured to contact the underlying structural members. The base members 14, 16 may include structures intended to promote connection with an adhesive or elastomeric concrete. In certain embodiments, the base members 14, 16 comprise a bottom surface or surfaces 20 which are positioned in contact with an adhesive or cementitious composition which acts as the interface between the base members and the underlying structural members 10, 12. Alternatively, the base members 14, 16 are attached to the structural members 10, 12 with mechanical fasteners 22. The mechanical fasteners 22 may comprise anchors, bolts, nails, rivets, screws, tacks and the like.

The base members 14, 16 include elongated edge channels or tracks 24, 26 that extend along the edge of base members 14, 16 and along the longitudinal axis of the expansion joint gap. The elongated openings 24, 26 may include any suitable elongated opening that is configured for, and capable of, accepting the cylindrical slide bearings of the cover assembly, and which permit the slide bearings to slide back-and-forth within the openings 24, 26 along the longitudinal axis of the cover assembly. The edge openings 24, 26 formed in the base members 14, 16 may comprise channels, notches, passages, recesses, slots, tracks, rails, or grooves adapted for engaging the slide bearings of the swing arms of the cover assembly in sliding engagement.

Figure 2A:
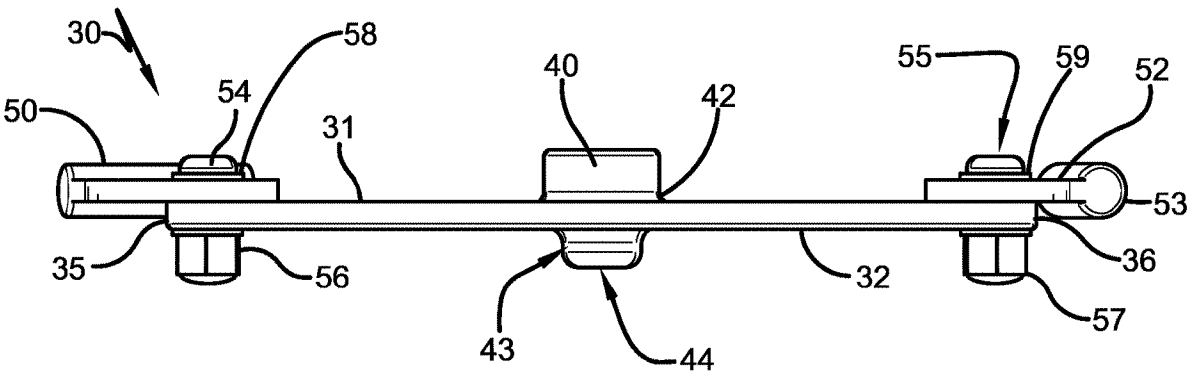
FIG. 2A shows a side view of an illustrative embodiment of the elongated swing arms of the expansion joint cover assembly.
Figure 2B:
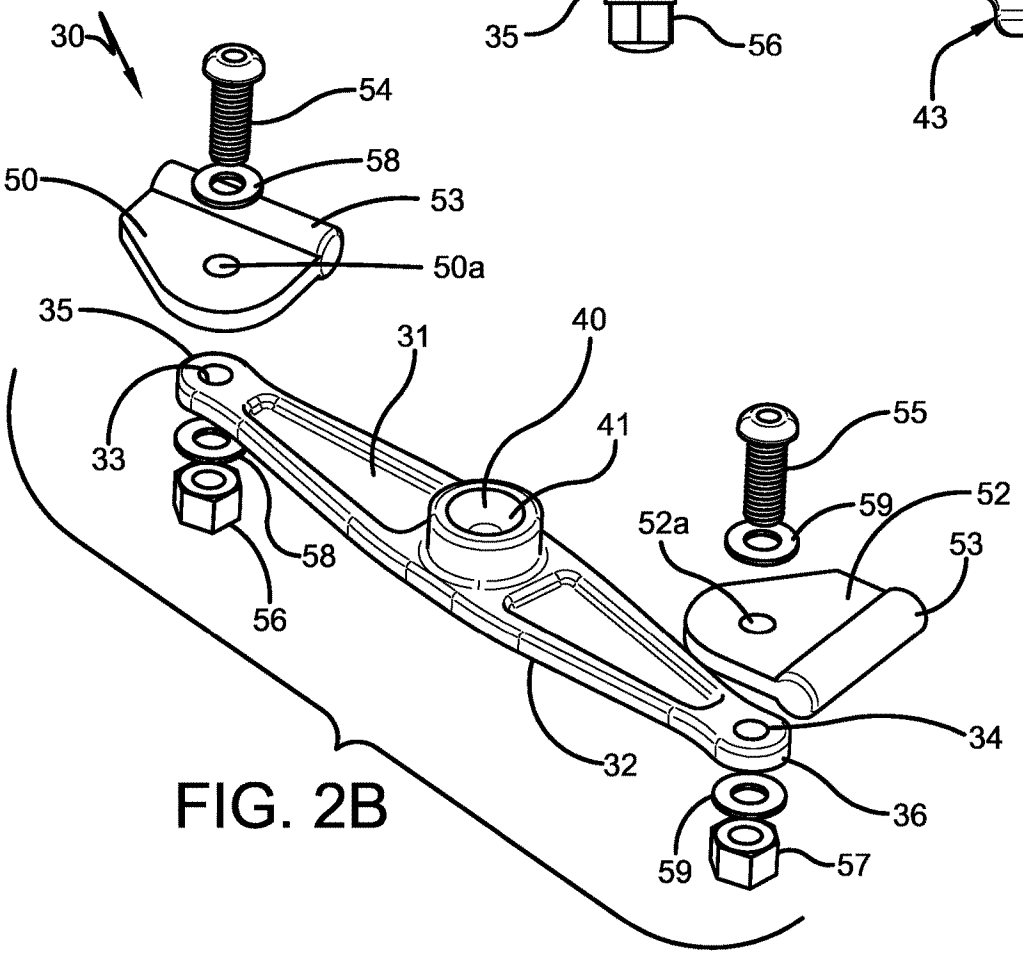
FIG. 2B shows an exploded perspective view of an illustrative embodiment of the elongated swing arms of the expansion joint cover assembly.
Figure 2C:
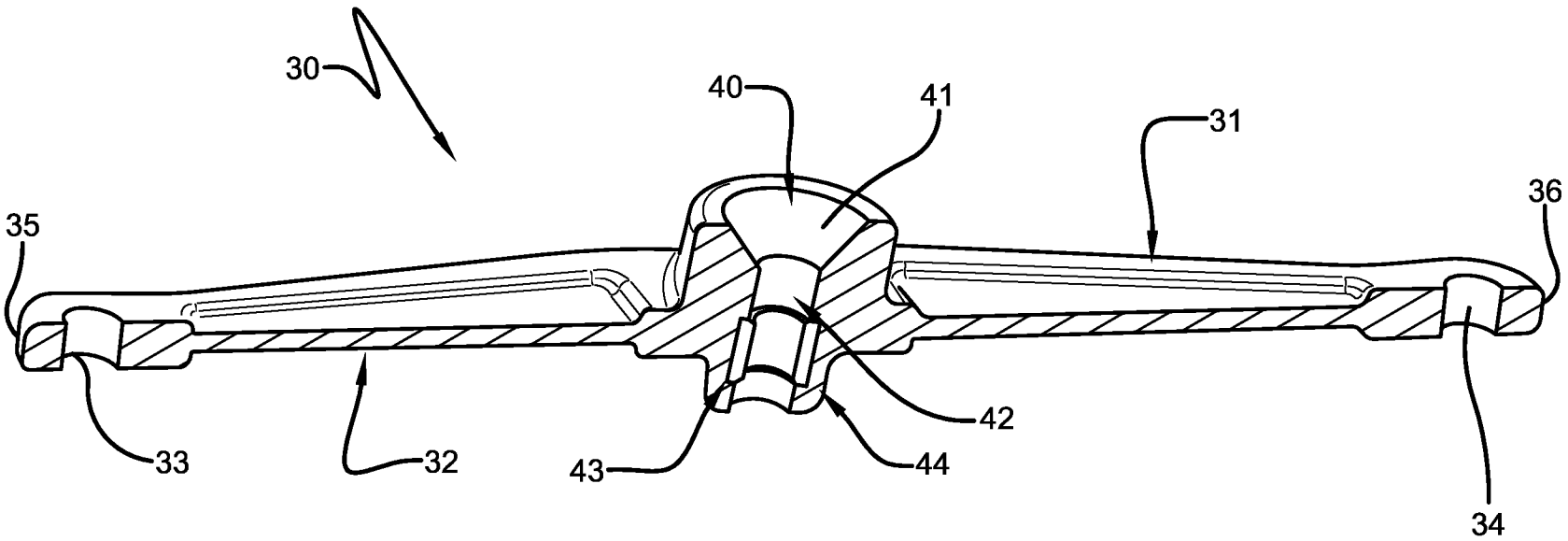
FIG. 2C shows a cross-sectional view of an illustrative embodiment of the elongated swing arms of the expansion joint cover assembly.

The cover assembly includes at least two swing arms 30 spanning the expansion joint gap between the two spaced apart structural members 10, 12. As shown in FIGS. 2A-2C, swing arms 30 include opposite facing first 31 and second 32 surfaces. Swing arms 30 further include openings 33, 34 that are located at or near first 35 and second 36 opposite ends and which communicate through first 31 and second 32 surfaces of the swing arms 30. Swing arms 30 include a receiver 40, such as a substantially cylindrical receiver well, for receiving a fastener for fastening the cover plate of the assembly to the swing arms 30. Fastener receiver 40 extends upwardly from the first surface 31 of the swing arms 30. Fastener receiver 40 includes an opening having a substantially inverted conical shaped inner surface 41. The inverted conical shaped inner surface 41 transitions from a larger inner circumference to a smaller inner circumference in the direction of the first surface 31 of the swing arm 30. The inverted conical shaped inner surface 41 terminates into a fastener shoulder 42 portion of the receiver 40. Positioned downwardly from fastener shoulder 42 is fastener locking member 43. According to the embodiment shown, fastener locking member 43 comprises an internally threaded nut to engage an externally threaded fastener. The internally threaded fastener locking member 43 sits in a fastener housing 44. The internally threaded fastener locking member 43 may be comprised of a metal or metal alloy. According to certain embodiments, the internally threaded member 43 is manufactured from a metal alloy, such as brass. As shown in FIGS. 2A and 2B slide bearings 50, 52 are pivotably engaged to the opposite terminal ends 35, 36 of the swing arms 30 via openings 50*a* and 52*a*. Each of the slide bearings comprises a substantially planar tab or wing portion 51 and a cylindrical portion 53.

The slide bearings 50, 52 may be engaged with the swing arms 30 by elongated externally threaded fasteners 54, 55, internally threaded locking nuts 56, 57, and washers 58, 59. A portion of the tab 51 of slide bearings 50, 52 is adjacent the first surface 31 of the swing arms 30. The cylindrical portion 53 of the bearings 50, 52 extend beyond the terminal ends 35, 36 of the swing arms and are configured to be inserted into the edge channels 24, 26 of the base members 14, 16 of the cover assembly.

The engagement allows each end 35, 36 of the swing arm members 30 to translate along a path defined by the openings 24, 26 of the base members 14, 16 that retain the particular sliding bearing 50, 52 as shown in FIGS. 1A-1C, 3 and 4. Slide bearings 50, 52 are engaged with rails 24, 26 of the base members 14, 16 to permit movement of the swing arms 30 within the expansion joint gap 13 located between the spaced apart structural members 10, 12. As of a result of this manner of engagement, opposite end portions of the swing arms 30 slide along the longitudinal paths defined by the rails 24, 26 of the respective base members 14, 16 in response to changes in the width of the gap. The sliding of the slide bearings 50, 52 of opposite end portions 35, 36 of the swing arms 30 results in rotation of the swing arms 30 within the plane of the cover assembly in the gap. This engagement permits rotation of swing arms 30 in response to movements in the vicinity of the expansion joint gap in order to accommodate the opening and closing of the expansion joint gap.

During contraction of the gap, the distance between the slide bearings 50, 52 decreases in the longitudinal direction but equilibrium is maintained by increasing the distance between end portions 35, 36 of the swing arms 30 in either the transverse direction, the vertical direction, or both, such that member need not change in length. During expansion of the gap, the distance between the sliding bearings 50, 52 increases in the longitudinal direction but equilibrium is maintained by decreasing the distance between the sliding bearings 50, 52 in either the transverse direction, the vertical direction, or both, such that swing arms 30 need not change in length.

The track, slot, track, rail, or groove 24, 26 formed in the edges of the base members 14, 16 defines the path along which the slide bearings 50, 52 of the swing arms 30 will translate in response to changes in the width of the gap. In certain embodiments, the connection between the base members 14, 16 and swing arms 30 comprises a female track 24, 26 formed in the base member 14, 16 and the cylindrical rail bearing portion 53 formed in the slide bearings 50, 52 that are positioned at the opposite ends 35, 36 of the swing arms 30.

The tracks formed in the edges of the base members 14, 16 are substantially linear and parallel to one another. According to certain illustrative embodiments, portion 53 of the slide bearings 50, 52 at the ends 35, 36 of swing arms 30 are substantially cylindrical or tubular in shape, and are adapted to slide within a female track 24, 26 of the base members 14, 16.

Figure 3:
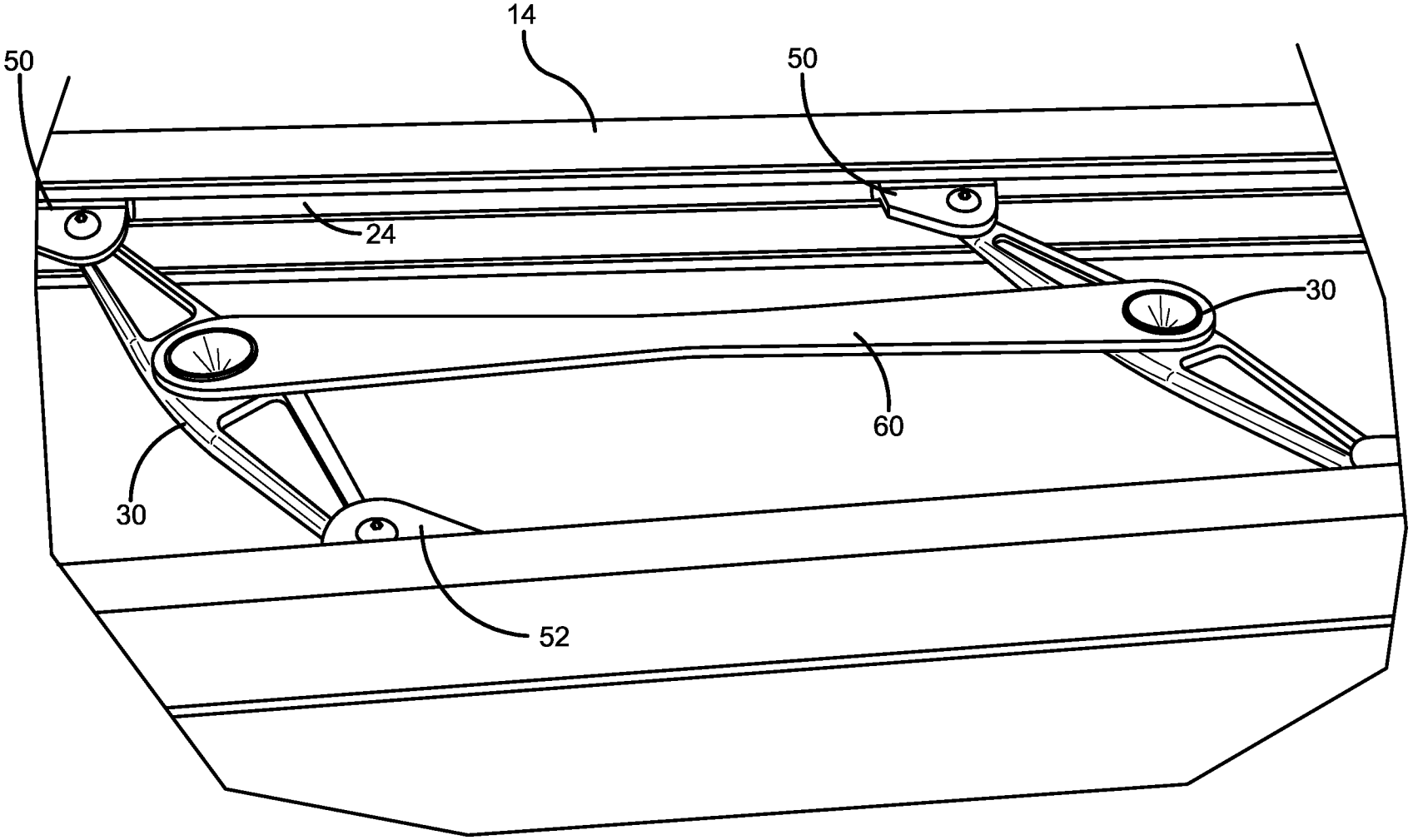
FIG. 3 shows a top perspective view of an illustrative embodiment of the expansion joint cover assembly.
Figure 4:
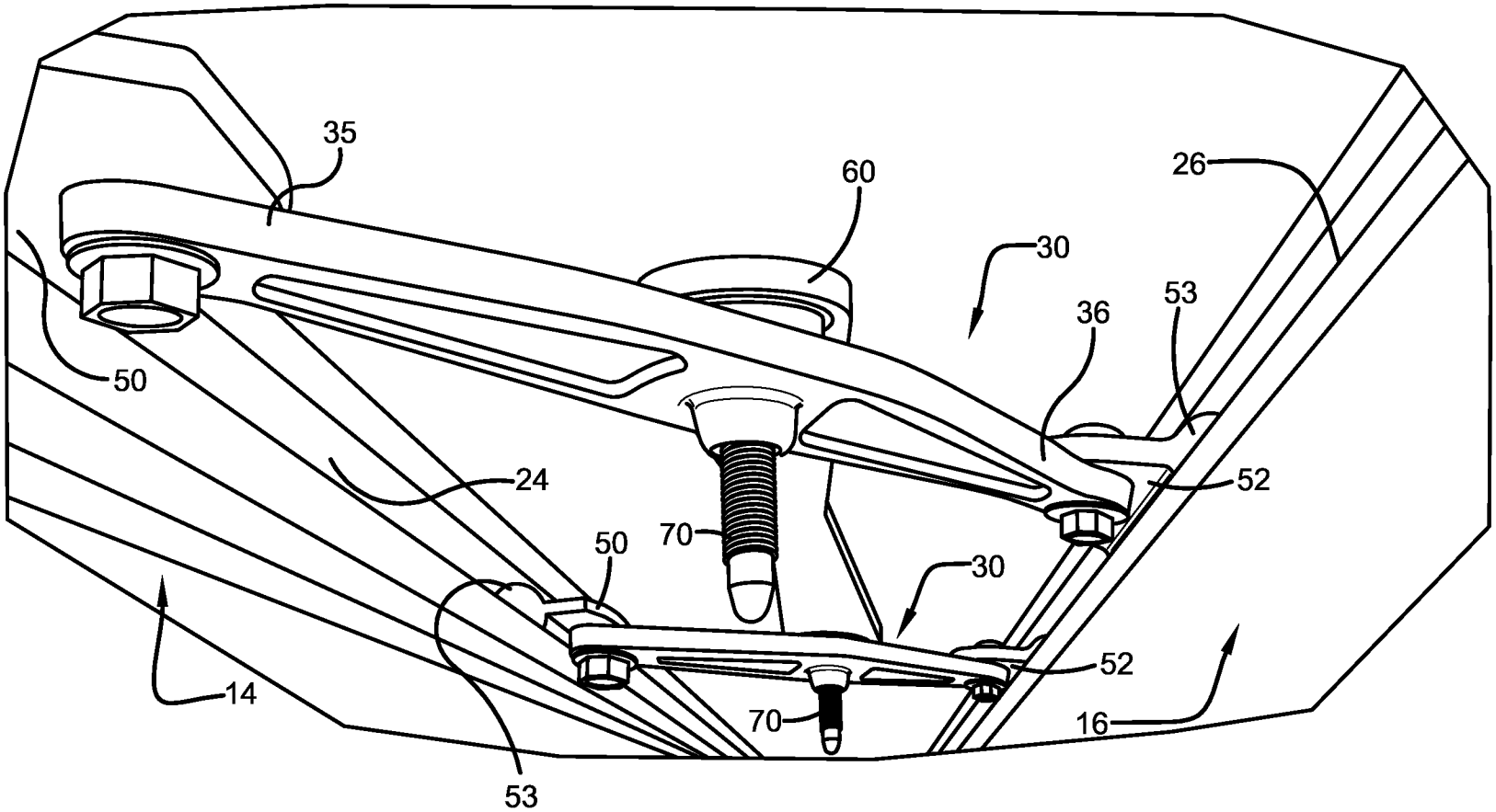
FIG. 4 shows a bottom perspective view of an illustrative embodiment of the expansion joint cover assembly.
Figure 5:
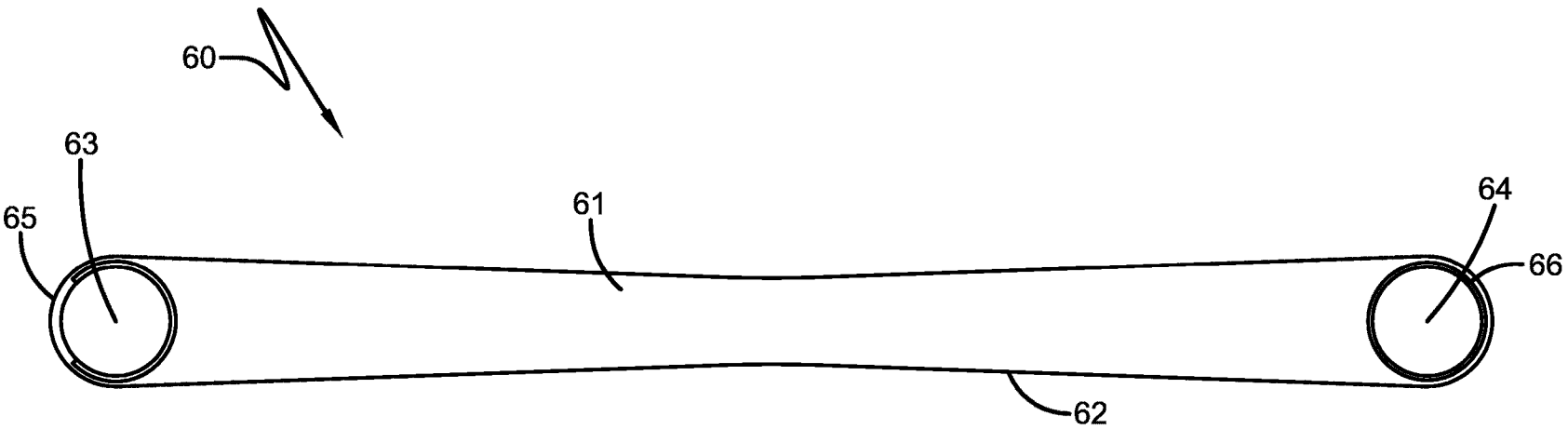
FIG. 5 shows an illustrative embodiment of the elongated spacer arm for connecting together adjacent elongated swing arms of the expansion joint cover assembly.

The optional elongated spacer arm 60 is shown in FIG. 5 Elongated spacer arm 60 includes opposite facing first 61 and second 62 surfaces. Elongated spacer arm 60 also includes openings 63, 64 located at opposite ends 65, 66 of the spacer arm 60. Openings 63, 64 communicate through first 61 and second 62 surfaces of the spacer arm 60. As shown in FIGS. 3 and 4, elongated spacer arm 60 extends between two consecutively positioned swing arms 30 along the longitudinal axis of the cover assembly. The elongated spacer arm 60 is engaged with the swing arms 30 by engaging the openings 63, 64 with the fastener receiver 40 of the swing arms 30. The elongated spacer arm 60 maintains the distance between the consecutive swing arms 30.

Figure 6:
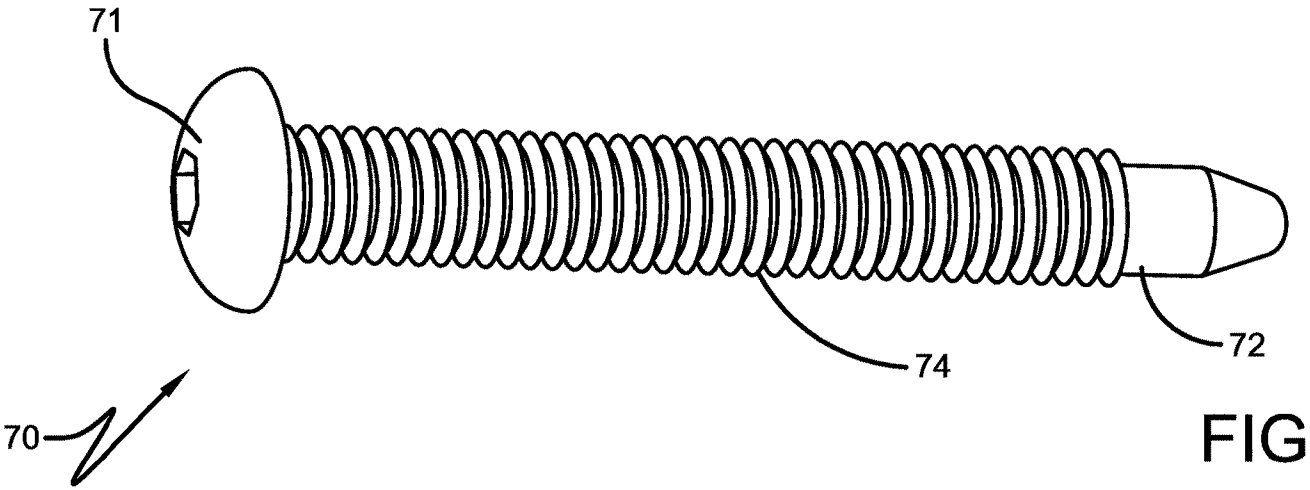
FIG. 6 shows an illustrative embodiment of the elongated mechanical fastener for fastening the swing arms to the cover plate of the expansion joint cover assembly.

As shown in FIG. 6, the mechanical fastener 70 for fastening the cover plate of the cover assembly to the underlying swing arms 30 may comprise an elongated externally threaded fastener bolt 70. The elongated fastener 70 includes a head 71 at one end. The fastener 70 includes a bullet-shaped tip 72 at the opposite end of the fastener 70. According to certain illustrative embodiments, the fastener 70 includes a non-metallic bullet-shaped tip 72 which makes locating the fastener receiver 40 of the swing arm 30 easier when installing the cover plate across the expansion joint gap. According to certain embodiments, the non-metallic bullet-shaped tip 72 of the fastener 70 comprises a polymer material that is adapted to easily slide downwardly along the inverted conical inner surface 41 of the fastener receiver 40 until it reaches the alignment shoulder 42 and locking member 44. According to certain embodiments, the elongated fastener 70 includes external threads 74 that extend the length of the fastener 70 from the head 71 to the bullet-shaped tip 72.

Figure 7:
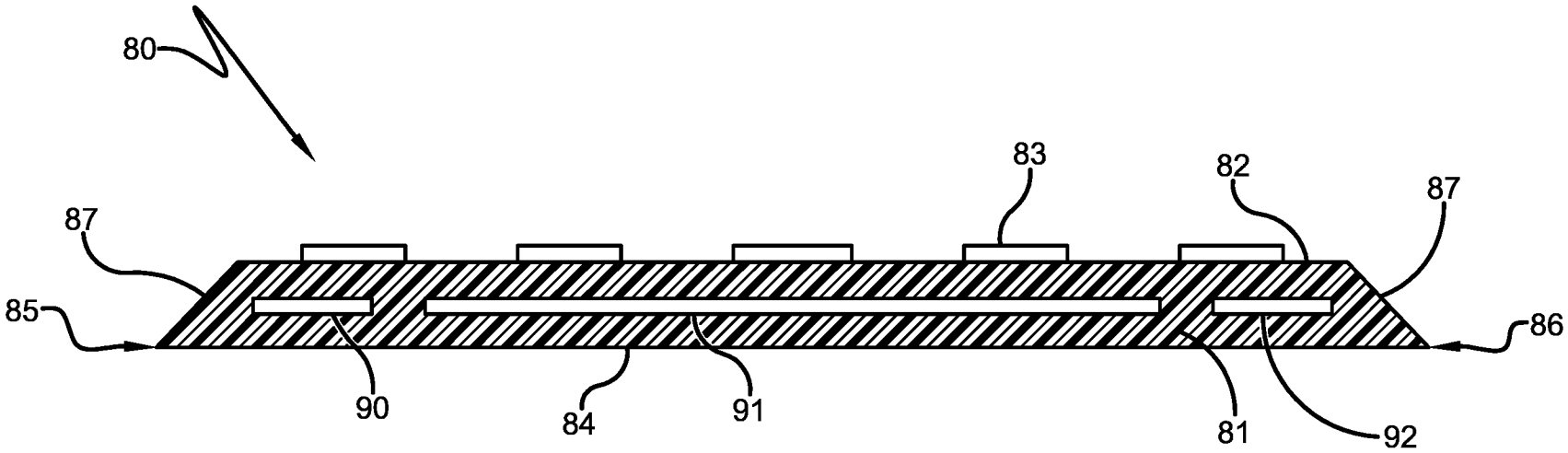
FIG. 7 shows an illustrative embodiment of the cover plate of the expansion joint cover assembly.

Any suitable cover plate that is configured to bridge or otherwise the expansion joint gap between two spaced apart structural members and which is capable of supporting pedestrian or vehicular traffic may be used as the cover plate of the present expansion joint cover assembly. A non-limiting example of a suitable cover plate is shown in FIG. 7. It should be noted that the cover plate shown in FIG. 7 is merely illustrative of the wide range of cover plates that could be used in the assembly. As shown in FIG. 7, the cover 81 of the cover plate 80 comprises a flexible, elastic strip-like member having a substantially upwardly directed load bearing face surface 82. The load bearing face surface 82 comprises spaced apart upstanding ribs 83 arranged to extend transversely to the direction of traffic for improved traction. Opposite the upwardly directed load bearing face surface 82, is the substantially downwardly directed support surface 84. The support surface 84 engages with a supporting surface 18 on each base member 14, 16. The opposite lateral terminal edges 85, 86 of the cover 81 have tapered face surfaces 87 for providing inclined planes 87 for smoothing the transition from the traffic bearing surface of one of the structural members 10 and to the cover 81 and then from the cover 81 to the traffic bearing surface of one of the structural members 12.

Still referring to FIG. 7, three spaced apart, substantially parallel, plate members 90, 91, 92 are encapsulated within the elastomeric cover 81. The plate member 91 is located at a substantially central position to overlie the gap and protect the gap and the edges of structural members 10, 12 and by forming a bridge to transfer the forces from traffic to the upper surfaces of structural members 10, 12. Plate members 90, 92 are optional and provide structure and resiliency to hold the tapered face surfaces 87 in contact with the base members 14, 16. The plate rigid plate members 90, 91, 92 may be joined to the elastomeric cover 81 by means selected from full encapsulation, partial encapsulation, adhesives, mechanical fasteners, or combinations thereof. Suitable mechanical fasteners include, but are not limited to, nails, screws, tacks, bolts and rivets. The mechanical fasteners can be made from metal or a polymer material. The rigid plate members 90, 91, 92 may be rolled steel, stainless steel, galvanized steel, aluminum plates, or other materials of strength appropriate to the forces to which the plate members will be exposed. These forces will depend upon the particular application and can be readily determined by the skilled practitioner. In certain embodiments, all of the rigid plate members are composed of the same material. In certain embodiments, the plate members comprise galvanized steel plates.

In certain embodiments, the elongated resilient cover 81 is constructed of elastomeric material containing fillers and a plasticizer. The term "elastomeric" refers to a material that possesses rubber-like properties, for example, an elastomeric material will substantially recover its original dimensions after compression and/or elongation. Any elastomeric material may be used to prepare the resilient cover 81 of cover plate 80, so long as the cover 81 can be prepared to a thickness and sufficient elasticity to elastically deform to establish supporting contact between the marginal support areas of the cover assembly and the underlying horizontal structural members 10, 12 to provide a smooth transition over the gap or opening for pedestrian or vehicular traffic.

Referring again to FIGS. 1A-1C, one or more installation fasteners 70 extend through suitable openings 88 arranged at spaced apart locations along the longitudinal axis of the resilient cover 81 and each fastener 70 extends through openings 88 and is engaged with the underlying swing arms 30. The cover 81 comprises an elastic material, such that spaced apart fastener receptacle holes 88 are uninhibited from elastic deformation to prevent dislodgment and breakage of the fastener 70. The elastic construction of the cover 81 permits elastic conformation into supporting contact with the underlying support structures 10, 12, which can have irregular configurations without the loss of supporting contact. This insures stability to the cover 81 which is enhanced by the weight represented by the mass of the plates 90-92.

Figure 8A:
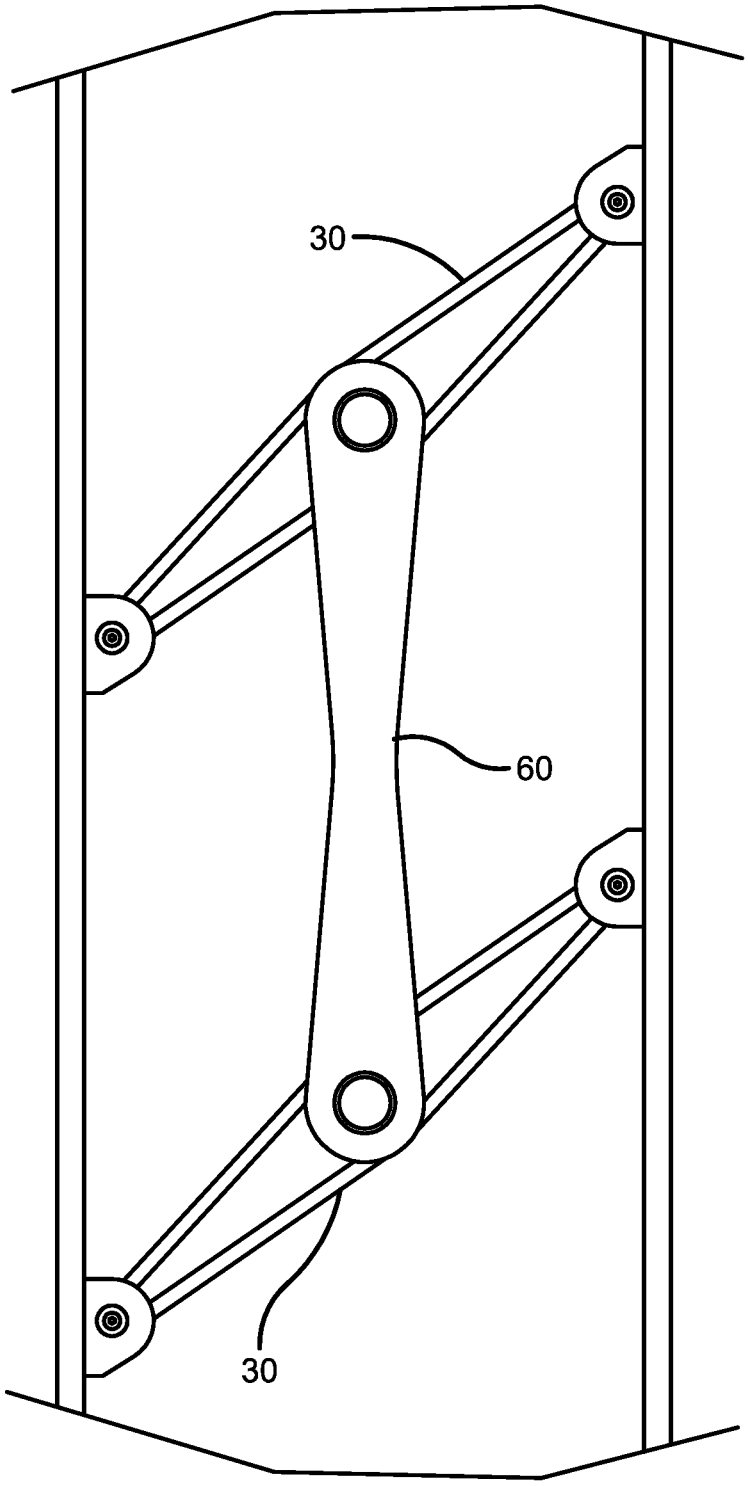
FIGS. 8A-8C show the expansion joint cover assembly without the cover plate in the neutral, opened and closed positions.
Figure 8B:
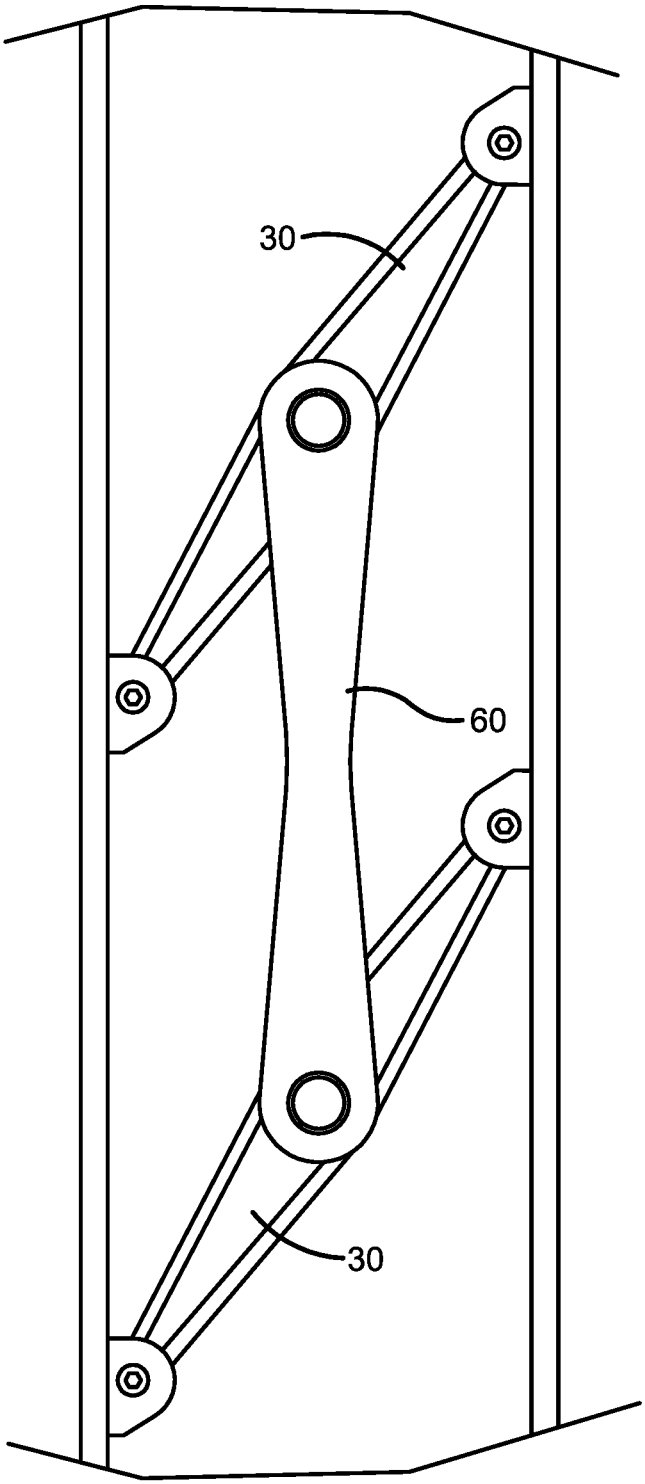
Figure 8C:
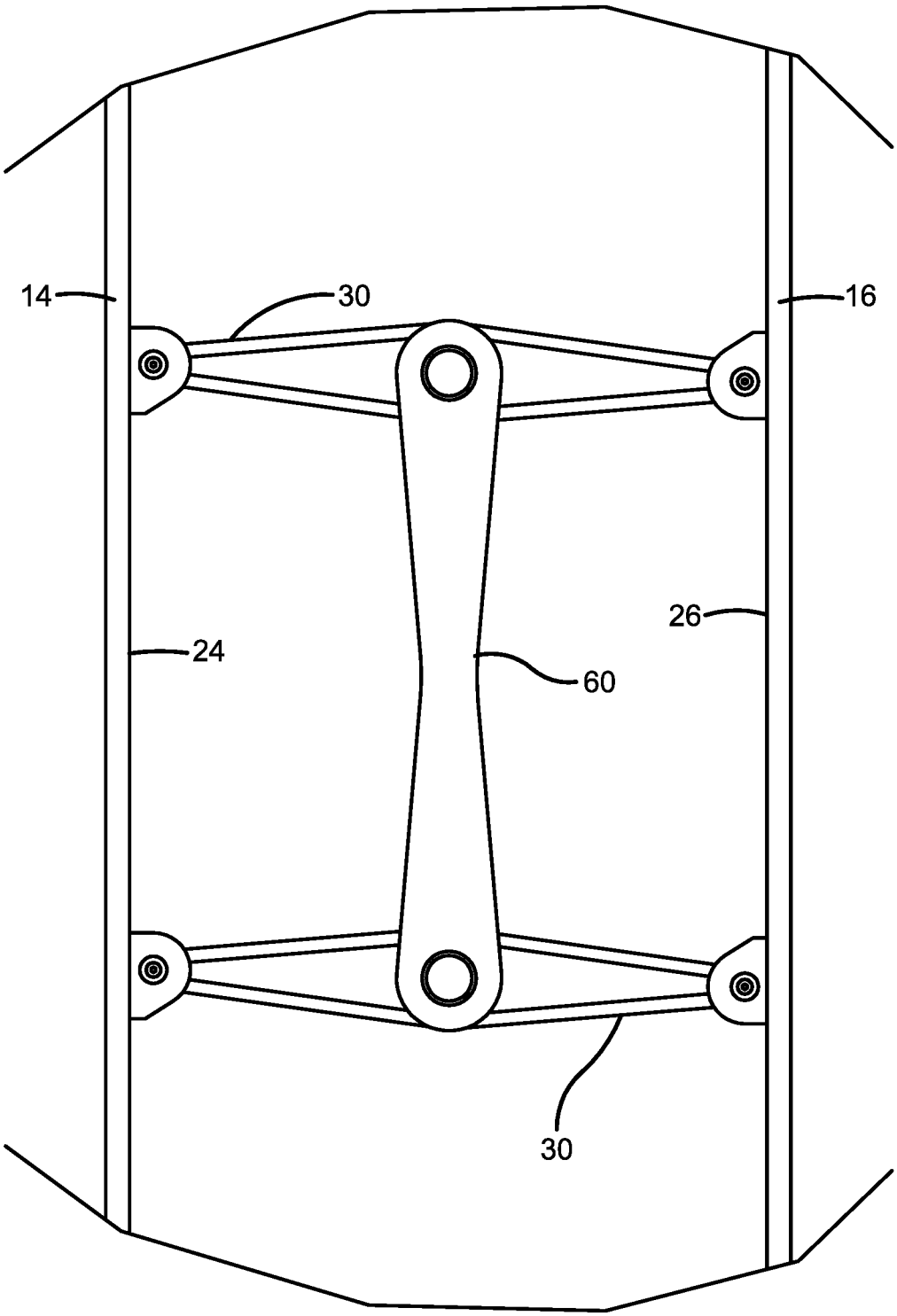

The mode of operation of the expansion joint cover assembly is shown in FIGS. 8A-8C. As shown in FIG. 8A, two spaced apart swing arms 30 are connected by elongated spacer arm 60. The slide bearings 50, 52 on both opposite ends 35, 36 of the swing arms 30 are engaged with and movable within the rails 24, 26 formed in the base members 14, 16. FIG. 8A shows the cover assembly in the neutral position. During contraction of the gap 14 between base members 10, 12, the distance between the sliding bearings 50, 52 on the swing arms 30 increase in the longitudinal direction as shown in FIG. 8B. During expansion of the gap 14 between members 10, 12, the distance between the sliding bearings 50, 52 on the swing arms 30 decreases in the longitudinal direction as shown in FIG. 8C. While the distance between the sliding bearings 50, 52 in the longitudinal direction may change, the swing arms 30 need not change in length to accommodate different expansion joint gap sizes in response to movement of the spaced apart structural members 10, 12.

While the cover assembly has been described in connection with certain illustrative embodiments, as shown in the various figures, it is to be understood that other similar embodiments may be used or modifications and additions may be made to the described embodiments for performing the same function without deviating therefrom. Furthermore, the various illustrative embodiments may be combined to produce the desired results. Therefore, the cover assembly should not be limited to any single embodiment, but rather construed in breadth and scope in accordance with the recitation of the appended claims.

The invention claimed is:

1. An expansion joint cover assembly for a gap between spaced apart structural members comprising:

base members configured to be affixed to each of said structural members and having channels configured to accept bearings;

a cover plate having a width sufficient to bridge said gap between said structural members;

swing arms pivotably engaged with said cover plate, wherein said swing arms have opposite facing first and second surfaces and a substantially centrally positioned fastener receiver extending upwardly from said first surface of said swing arms, an opening communicating through said first and second opposite facing surfaces of swing arms, and wherein said fastener receiver is defined by an opening comprising an inverted conical inner surface in the direction of said first surface of said swing arms and transitioning into a fastener alignment shoulder; and bearings engaged at opposite ends of said swing arms and slidably engaged with said channels of said base members, wherein said bearings comprise a substantially planar tab portion and an elongated cylindrical portion.

2. An expansion joint cover assembly for a gap between spaced-apart structural members comprising:

base members configured to be affixed to each of said structural members and having channels configured to accept bearings;

a cover plate having a width sufficient to bridge said gap between said structural members, wherein said cover plate comprises an elongated resilient cover having a load bearing surface opposite a support surface and at least one rigid plate member engaged with said elongated resilient cover, wherein said rigid plate member bridges said gap between said structural members;

swing arms pivotably engaged with said cover plate, wherein said swing arms have opposite facing first and second surfaces and a substantially centrally positioned fastener receiver extending upwardly from said first surface of said swing arms;

wherein said fastener receiver comprises an opening communicating through said first and second opposite facing surfaces of swing arms, and wherein said fastener receiver is defined by an opening comprising an inverted conical inner surface in the direction of said first surface of said swing arms and transitioning into a fastener alignment shoulder; and bearings engaged at opposite ends of said swing arms and slidably engaged with said channels of said base members, wherein said bearings comprise a substantially planar tab portion and an elongated cylindrical portion.

3. An expansion joint cover assembly for a gap between spaced-apart structural members comprising:

base members configured to be affixed to each of said structural members and having channels configured to accept bearings;

a cover plate having a width sufficient to bridge said gap between said structural members, wherein said cover plate comprises an elongated resilient cover having a load bearing surface opposite a support surface and at least one rigid plate member engaged with said elongated resilient cover, wherein said rigid plate member bridges said gap between said structural members, swing arms pivotably engaged with said cover plate, wherein said swing arms have opposite facing first and second surfaces and a substantially centrally positioned fastener receiver extending upwardly from said first surface of said swing arms;

wherein said fastener receiver comprises an opening communicating through said first and second opposite facing surfaces of swing arms, and wherein said fastener receiver is defined by an opening comprising an inverted conical inner surface in the direction of said first surface of said swing arms and transitioning into a fastener alignment shoulder;

wherein said fastener receiver further comprises a locking member extending downwardly from said fastener alignment shoulder;

a fastener comprising an elongated externally threaded bolt and wherein said locking member comprises an internally threaded locking nut, wherein said fastener engages said cover plate to said swing arms substantially along the median portion of said cover plate; and bearings engaged at opposite ends of said swing arms and slidably engaged with said channels of said base members, wherein said bearings comprise a substantially planar tab portion and an elongated cylindrical portion.

* * * * *